US007065934B2

(12) United States Patent
Allin

(10) Patent No.: US 7,065,934 B2
(45) Date of Patent: Jun. 27, 2006

(54) METHOD OF RETROFITTING A PROTECTIVE AND DECORATIVE VALANCE TO AN AWNING FOR USE WITH PERMANENT BUILDING STRUCTURES

(75) Inventor: John Michael Allin, Concord Township, OH (US)

(73) Assignee: Crest Products Inc., Mentor, OH (US)

( * ) Notice: Subject to any disclaimer, the term of this patent is extended or adjusted under 35 U.S.C. 154(b) by 0 days.

(21) Appl. No.: 11/030,029

(22) Filed: Jan. 6, 2005

(65) Prior Publication Data

US 2005/0115163 A1 Jun. 2, 2005

(51) Int. Cl.
*A47H 23/00* (2006.01)

(52) U.S. Cl. ..... 52/745.2; 52/74; 52/717.03; 160/38

(58) Field of Classification Search ..... 52/74–77, 52/718.01, 717.06, 745.2, 717.01, 717.03, 52/DIG. 12; 160/330, 350, 38
See application file for complete search history.

(56) References Cited

U.S. PATENT DOCUMENTS

| | | | | |
|---|---|---|---|---|
| 2,189,567 | A * | 2/1940 | Miller | 160/392 |
| 3,100,012 | A * | 8/1963 | Dunn | 160/89 |
| 3,612,145 | A * | 10/1971 | Darula et al. | 160/67 |
| 5,148,640 | A * | 9/1992 | Reilly, Sr. | 52/74 |
| 5,381,844 | A * | 1/1995 | Struben | 160/46 |
| 6,494,246 | B1 * | 12/2002 | Blevins | 160/67 |

* cited by examiner

*Primary Examiner*—Naoko Slack
(74) *Attorney, Agent, or Firm*—Fay, Sharpe, Fagan, Minnich & McKee, LLP

(57) ABSTRACT

An all-season awning system 10 is provided with an aesthetically pleasing protective valance 12 for use with associated permanent building structures 14. The awning system includes a peripheral frame covered substantially entirely by a fabric valance member 32. The fabric valance member is carried on selected portions of the peripheral frame 20 using an attachment means including an elongate tube carried within a fold of the valance and received into a corresponding slot formed in an attachment member coupled with the lateral support member. The valance can be retrofitted onto existing awning structures by connecting the attachment member to the lateral support member using suitable fasteners such as screws or the like.

3 Claims, 5 Drawing Sheets

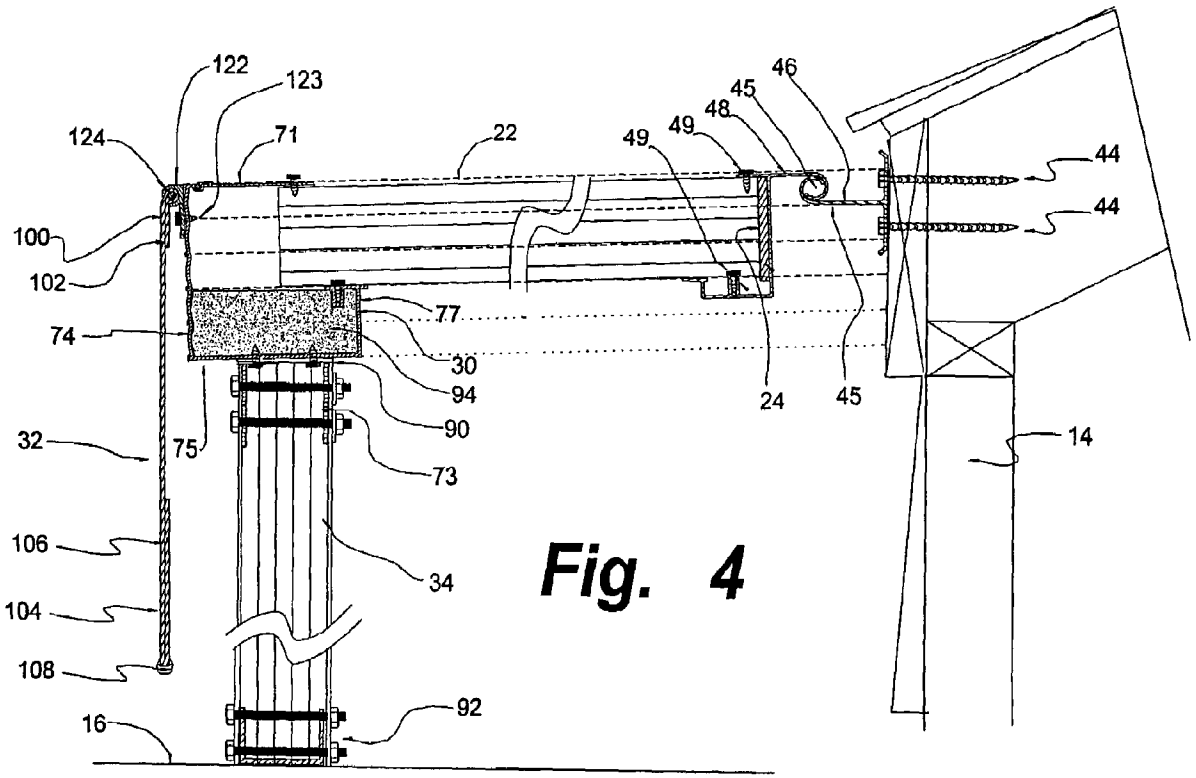
Fig. 4
Fig. 4a
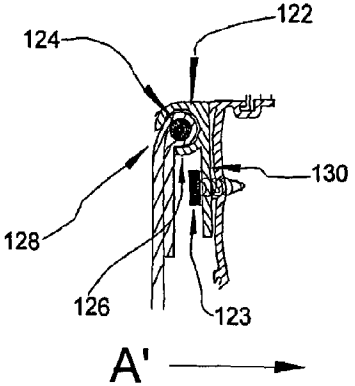

METHOD OF RETROFITTING A PROTECTIVE AND DECORATIVE VALANCE TO AN AWNING FOR USE WITH PERMANENT BUILDING STRUCTURES

BACKGROUND OF THE INVENTION

The subject invention is directed to the art of awning systems and, more particularly, to an all-season awning apparatus with an aesthetically pleasing and protective valance for use with associated permanent building structures and to methods and apparatus for attaching the protective valance to building structures. The invention will be described with particular reference thereto, however, it is to be appreciated that the invention has other applications including protective and decorative trim valances, and the like for permanent or rigid canopy structures, coverings, frameworks, or the like.

Prior art rigid metal awning structures have been provided with soft cloth valance trim. However, these structures lack eye appeal because the valance trim does not completely cover or otherwise hide from view the visible outer surfaces of the underlying rigid metal awning structure. To some observers, the "industrial" look of the awning detracts from otherwise pleasant architecture of the building structure.

As a general example, U.S. Pat. No. 5,381,844 teaches a portable two-way aluminum awning for use in connection with recreational vehicles. FIG. 1 herein is a cross-sectional illustration of the manner in which the aluminum awning structure of the '844 patent is adapted for receiving a soft cloth valance. Using the arrangement shown, the valance is held behind the out frame and is thus incapable of protecting the outer frame or shielding it from view.

More particularly, and turning now to that figure, a rigid aluminum support member 1 defines a front opening 2 for receiving associated support structures, and a rear opening 3 adapted to receive main body portions of a substantially planar aluminum awning structure 4. A plurality of adjacent slots or channels 5 are provided in the extrusion 1 for receiving a section of soft canvas or cloth valance trim.

In the prior art example described above, it is to be appreciated that in normal use the overall awning structure is viewed by an observer in the direction labeled A on the drawing figure. This being the case, the front portion 6 of the support extrusion 1 is clearly visible to the viewer. The canvas valance 7 supported in a selected one of the grooves 5 is therefore incapable of softening the aesthetics of the readily visible front portion 6 of the hard aluminum extrusion 1. In addition, the valance can provide no protection to the outer front face 6 of the extrusion 1 when supported relative to the frame 1 in the manner illustrated.

All permanent metal awning structures heretofore known are utilitarian structures lacking aesthetic sppeal. The art has long provided permanent metal awning structures where fastening screws, perimeter fascias and the like are exposed to view. These structures are often attached to beautiful homes and commercial buildings and serve to cheapen the home or building. Also, many potential home or commercial building owners were required to choose a wholly fabric awning to overcome the utilitarian appearance of the permanent metal awning structures.

Moreover, current art indicates that the canvas awning industry has failed to provide a product that can be designed to withstand the demands of seasonal snow and wind loads and as such offered products that were able to be used only on a seasonal basis and in the case of retractable awnings had to be stored away in defined wind conditions rendering them of no value when such conditions existed. Canvas or fabric awnings in the past have been fabricated and tied to metal pipe structures, and are removed and stored in the winter months in areas where snow accumulation that would damage the awning can be expected. This adds additional maintenance costs to that type of awning and does not provide for usage in the winter months.

Additionally, retractable or roll-up fabric awnings have been designed to address the seasonal removal issues but, due to structural limitations, also fail to provide permanent usage and offer little or no protection in rain or wind storms. Water ponding during a rainfall can cause them to collapse and winds over 25 miles per hour generally expose retractable awnings to torque conditions which lead to the awning being ripped away from the supporting structure. Special motorized wind sensors are installed to sense wind conditions and retract the awning with an electric motor device when these conditions arise. The present invention offers an awning system that can be installed and utilized for year-round use.

Attractive or pleasing-to-the-eye permanent awning structures having aesthetic fabric valances for covering fastening screws, perimeter fascias and the like are not found in the prior art.

There is a clear need in the awning industry for a system that provides a permanent four-season awning structure having the appearance of a work of art rather than merely a utilitarian structure. Moreover, there is a need for an aesthetic permanent four-season awning structure which combines the soft look of fabric with the durable qualities of the underlying structure that enables the fastening means and the perimeter fascias to be hidden from view. The needed awning structure would enhance the appearance of the finest homes and commercial buildings and add significant value thereto, rather than detract therefrom as is the case with the systems known prior to this disclosure. Additionally, a fabric valance is needed which can be easily removed for replacement or storage in about thirty minutes with only a common screwdriver as the required tool.

It would, therefore, be desirable to provide an awning system formed of metal and including a cloth valance trim which both covers or otherwise hides the outer visible surfaces of the awning support members and also protects those surfaces.

It is also desirable to provide a method and apparatus for supporting a cloth valance relative to awning structures to cover and protect otherwise visible surfaces of support and frame portions of the awning structures.

SUMMARY OF THE INVENTION

The subject invention provides an improvement to aluminum awning structures of the type described which produces an aesthetically pleasing and protective valance trim system for use with associate permanent building structures. In addition, the invention can be readily used in an installed base of aluminum awning structures by a simple retrofitting process. In that way, the invention is useful in not only newly manufactured products, but in devices already placed in service.

In accordance with an aspect of the invention, there is provided an all-season awning system with an aesthetically pleasing protective valance for use in connection with associated permanent building structures. The awning system includes a metal peripheral frame carrying a substantially planar main body portion and a fabric valance member substantially covering the entire front visible surfaces of the peripheral frame. The peripheral frame includes an elongate header member having first and second ends and is adapted for attachment to the associated permanent building structure. A first elongate transverse support member has first and second ends, the first end being operatively coupled with the first end of the elongate header member. A second elongate transverse support member has first and second ends as well, the first end thereof being operatively coupled with the second end of the header member. Lastly, a lateral support member is operatively coupled between the first and second free ends of the first and second elongate support members thereby forming the peripheral frame. The lateral support member forms a planar substantially rectangular front face surface having a height and width. The fabric valance member covers the entire front face height but preferably covers both the front face height and width of the front face surface of the elongate lateral support member.

In accordance with a further aspect of the invention, the first elongate transverse support member forms a planar substantially rectangular first face surface having a height and width. A first portion of the valance member substantially covers the entire first face surface height but preferably covers both the first face surface height and width of the first elongate transverse support member.

In accordance with a still further aspect of the invention, the second elongate transverse support member defines a planar substantially rectangular second face surface having a height and width. A second portion of the fabric valance member substantially covers the entire second face surface height but preferably covers both the second face surface height and width of the second elongate transverse support member.

In its preferred form, the fabric valance member is carried on the lateral support member and on the first and second elongate transverse support members using a tube and resilient groove attachment system. A first elongate tubular member is carried in a fold formed by an upper edge of the fabric valance member. A second elongate attachment member provided with a slot for receiving the tubular member is operatively coupled with the support members. The walls forming the slot or groove of the second elongate attachment member are resiliently biased to permit insertion of the tubular member and valance fold using modest pressure and to hold the valance in place under normal loads. The fabric valance member can be selectively removed by simply decoupling the elongate tubular member from the attachment member slot.

The use of the described arrangement significantly enhances the aesthetic appeal of existing aluminum awning structures and provides a degree of protection thereof.

In view of the above, it is an advantage of the invention to provide an all season awning system with an aesthetically pleasing protective valance for use with associated permanent building structures.

It is another advantage of the invention to provide an all-season metal awning system with a fabric valance disposed to hide the metal frame from view.

It is another advantage of the invention to provide an awning system that can be installed and utilized for year-round use.

Still another advantage of the invention is to provide an aesthetic permanent four-season awning structure with a soft look fabric combined with the durable qualities of a metal structure that enable the fastening means and fascias to be hidden from view.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein:

FIG. 4 is a cross-sectional view of the subject awning system taken along line 4—4 of FIG. 3;

FIG. 4*a* is an enlarged portion of FIG. 4 showing the attachment means for clarity; and, FIG. 5 is cross-sectional view of the subject awning system taken along line 5—5 of FIG. 3.

DETAILED DESCRIPTION OF THE PREFERRED EMBODIMENT

Figure 1:
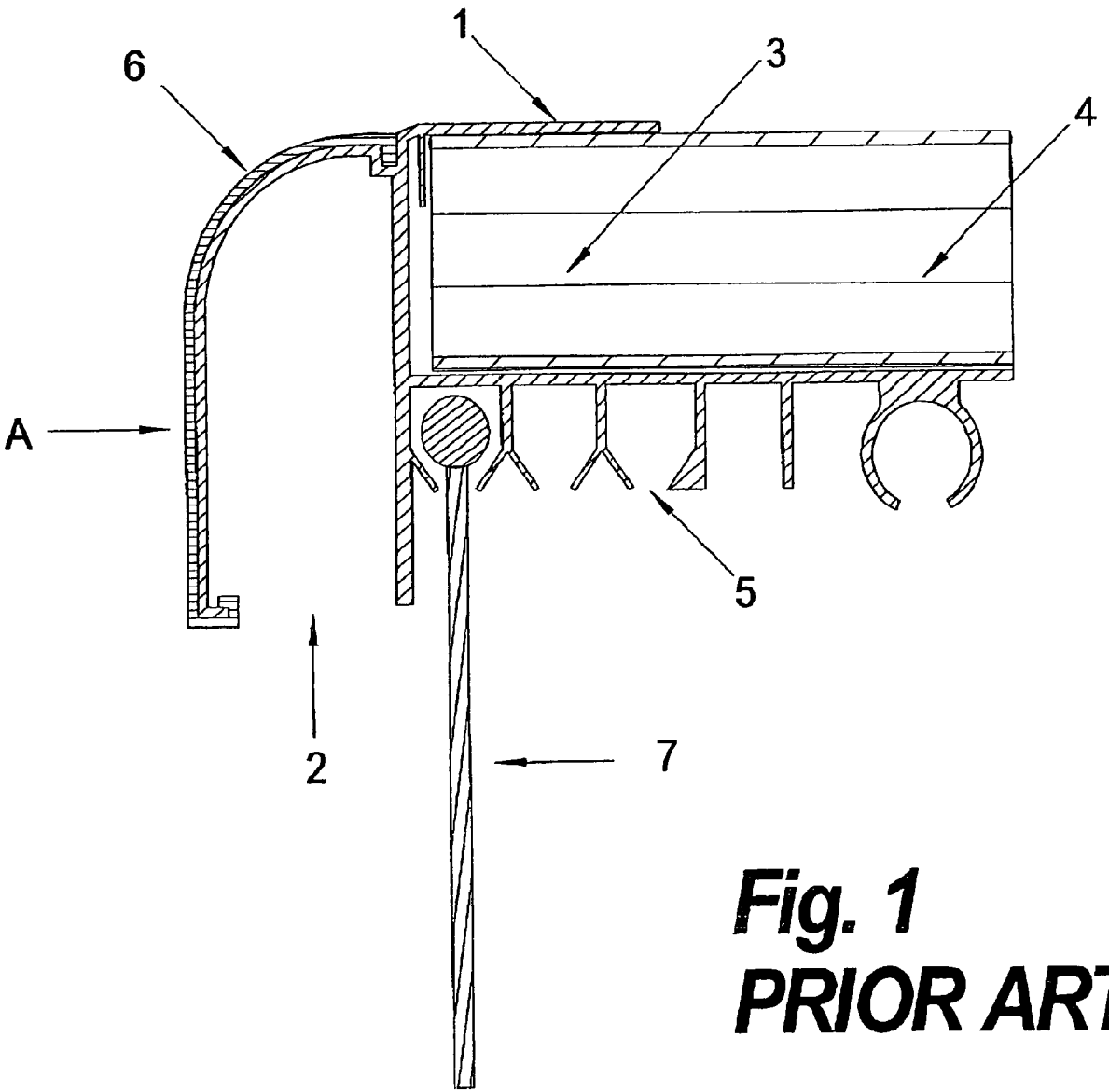
Fig. 1 PRIOR ART
FIG. 1 is a cross-sectional view of a selected portion of an aluminum awning structure in accordance with the prior art.
Figure 2:
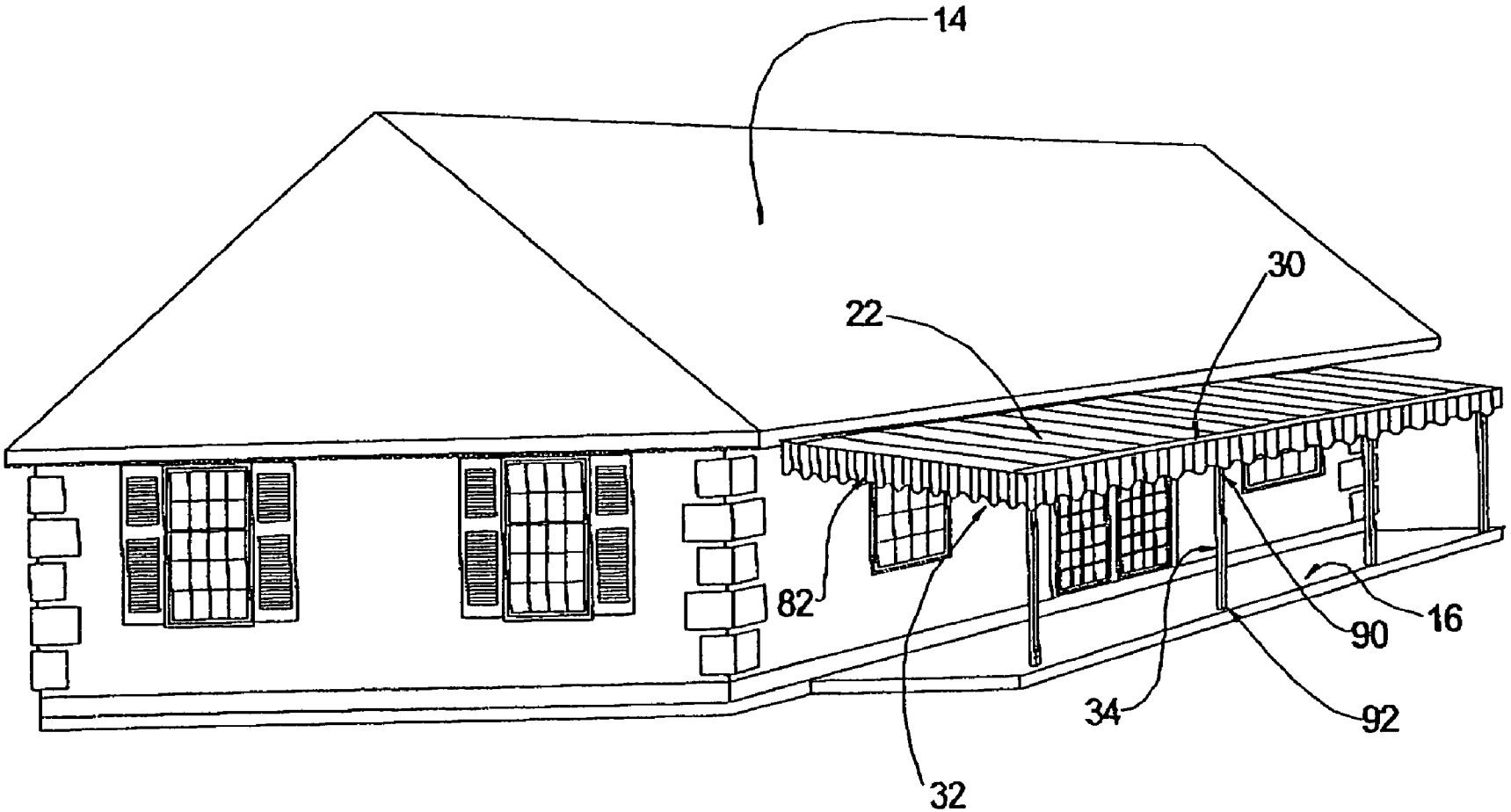
FIG. 2 is a perspective view illustrating the awning system of the invention in use with a typical associated permanent building structure.

Referring now to the drawings wherein the showings are for the purposes of illustrating the preferred embodiment of the invention only and not for purposes of limiting same, FIG. 2 shows the overall arrangement of the subject all-season awning system 10 with an aesthetically pleasing protective valance 12 for use with an associated permanent building structure 14. In the subject embodiment, the awning system 10 is used in conjunction with a dwelling structure but it is to be appreciated that the system can be used on any building structure and can, in some cases, be used in a stand-alone fashion, i.e. separate and apart from an associated permanent building structure.

Figure 3:
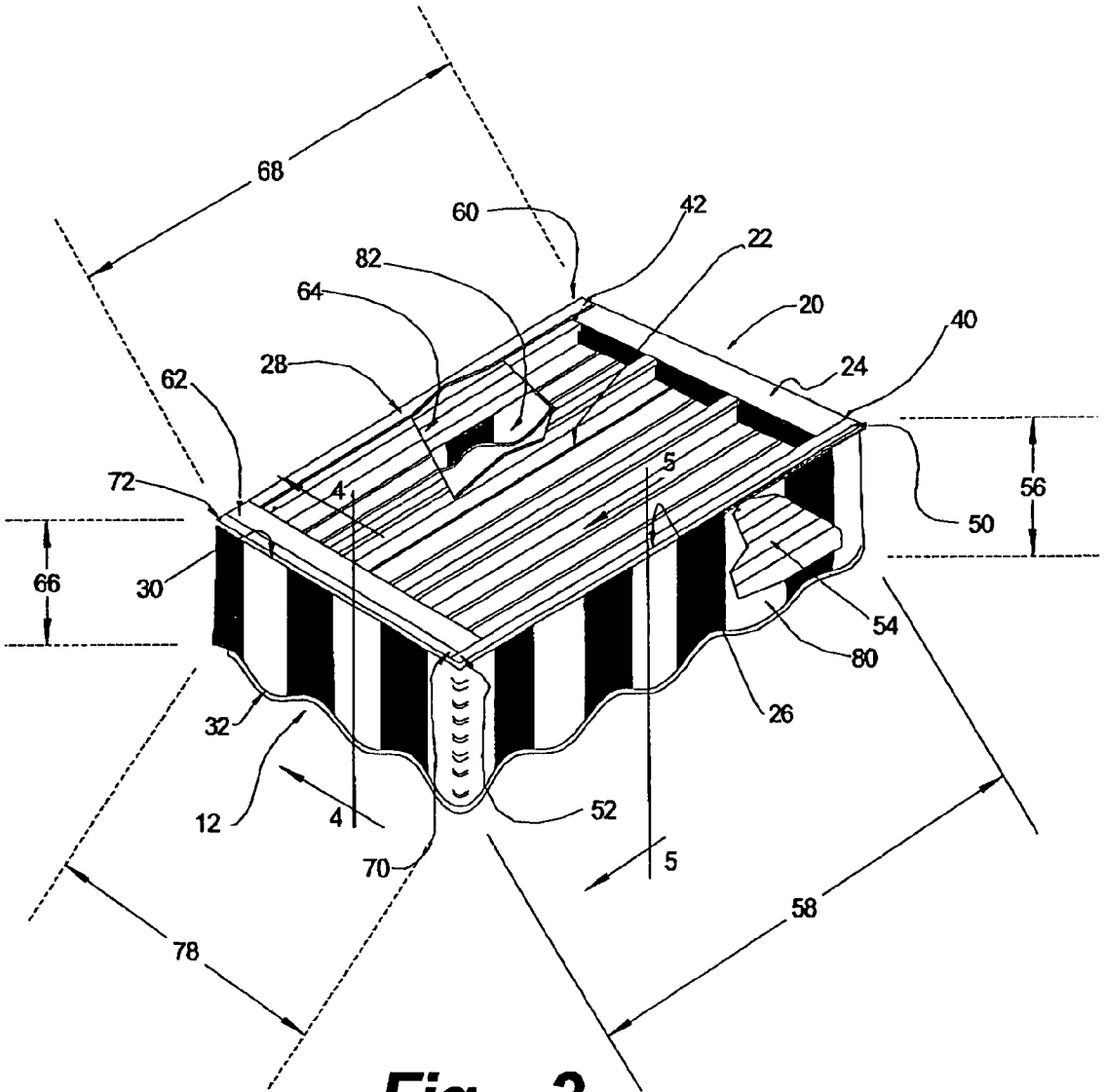
FIG. 3 is a perspective view of the subject awning system removed from the associated permanent building structure.
Figure 5:
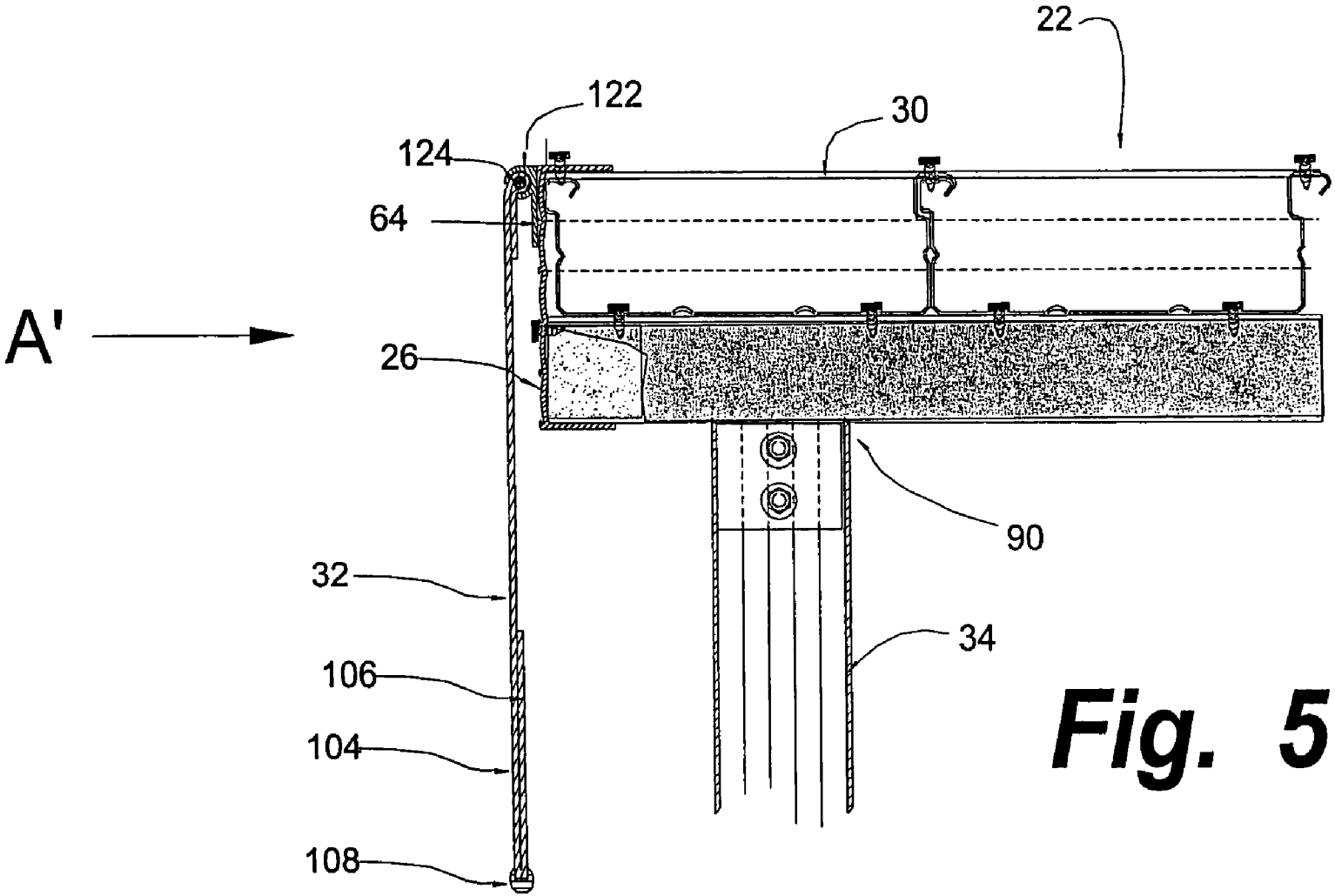

With continued reference to FIG. 2, and with additional reference to FIGS. 3–5, the subject all-season awning system 10 with an aesthetically pleasing protective valance 12 includes a peripheral frame 20 carrying a substantially planar main body portion 22. The peripheral frame 20 includes an elongate header member 24, a first elongate transverse support member 26, a second elongate transverse support member 28, and an elongate lateral support member 30. A fabric valance member 32 is carried on the transverse lateral support member 30 as shown.

The elongate header member 24, preferably formed of aluminum, defines a first end 40 and a second end 42. As shown best in FIG. 4, the header member 24 is adapted for attachment to the associated permanent building structure 14 by means of a plurality of fasteners 44, preferably lag bolts, and an intermediate hinge connector system 45 including a wall mount device 46 and a rear hanging rail 48. As illustrated, the rear hanging rail 48 is pivotable about a pivot point 45 relative to the wall mount device 46 held fixed in place relative to the associated permanent building structure 14. The rear hanging rail 48 is affixed to the header member 24 using suitable fasteners 49 such as sheet metal screws or the like.

The first elongate transverse support member 26, preferably formed of aluminum, defines first and second ends 50, 52, respectively. The first end 50 of the transverse support member 26 is operatively coupled with the first end 40 of the header member 24 as shown using any suitable means such as, sheet metal screws, fasteners or the like.

Similarly, the second elongate transverse support member 28, preferably formed of aluminum, defines a first end 60 and a second end 62. The first end 60 of the second elongate transverse support member 28 is operatively coupled with the second end 42 of the header member 24 again, using fasteners, sheet metal screws, or any other suitable means.

The elongate lateral support member 30 is coupled to the first and second transverse support members 26, 28 as illustrated. A first end 70 of the lateral support member 30 is operatively coupled with the second end 52 of the transverse support member 26 and a second end 72 of the lateral support member 30 is operatively coupled with the second end 62 of the second transverse support member 28.

As shown best in FIG. 4, the elongate lateral support member 30 forms a planar substantially rectangular front face surface 74 having a front face surface height 76, and a front face surface width 78 (FIG. 8). In accordance with the present invention, the fabric valance member 32 is held on the lateral support member 30 to substantially cover the entire front face height 76 of the front face surface 74. The front face surface 74 of the lateral support member 30 is completely covered when viewed by an observer in the direction labeled A' in the drawing Figure. Preferably, the fabric valance has a height dimension (H+X) greater than a height dimension H of the outer face surface. and has a width dimension (W+Y) greaterthan a width dimension W of the outer face surface.

With continued reference to FIG. 4, it is to be appreciated that the lateral support member 30 has a substantially "C" profile defined by the front face surface 74, a bottom wall 75, and a rear wall 77. As can be seen, a trough is formed at the bottom of the lateral support member 30 by the intersection of the bottom wall 75 with the rear wall 77 and the wall forming the front face surface 74. An integrated gutter system is thereby formed to direct water and other fluids flowing off from the main body portion 22 to the outer ends, namely the first end 70 and the second end 72 of the lateral support member 30.

Lastly with reference to FIG. 4, a top cap member 71 is provided for mechanically connecting an upper end of the front face surface 74 with the main body portion 77 of the awning system 10. The top cap member connected as illustrated substantially enhances the overall rigidity and ruggedness of the subject awning system 10. An upper post flange 73 is used to connect the bottom wall 75 of the lateral support member 30 to the upper end 90 of a support post member 34 using suitable fasteners such as bolts or the like as illustrated.

In the preferred embodiment, all of the peripheral frame 20 structure as well as the substantially planar main body portion 22 of the subject system is formed of metal, preferably aluminum. The fabric valance member 32 is preferably formed of any water resistant and fade-resistant material such as, for example, Sunbrella™ fabric. The fabric valance member 32 is held on the lateral support member 30 to substantially cover and hide the entire front face height 76 of the front face surface 74 from view. In that way, an aesthetically pleasing and protective covering is provided for the peripheral frame 20 of the subject awning system 10. This significantly improves the overall appearance of the awning structure and provides a degree of protection to the peripheral frame.

Preferably, as illustrated in the drawing figures, a first portion 80 of the valance member 32 extends to cover the entire first face surface 54 of the first transverse support member 26 when viewed in the direction labeled A'. Similarly, a second portion 82 of the valance member 32 covers substantially the entire second face surface 64 of the second support member 28 when viewed in the direction labeled A'. In that way, substantially the entire visible peripheral frame 20 of the subject awning system 10 is protected and hidden from view and the view thereof is enhanced by the aesthetically pleasing valance 12.

In its preferred form, the fabric valance member 32 includes an upper end 100 carrying an elongate tubular member 120 in a fold 102 provided in the upper end 100. The lower end 104 of the valance member 32 includes a similar fold 106 selectively carrying a weight device 108 so that the valance 12 is better able to resist wind gusts and the like.

As best shown in enlarged detail in FIG. 4*a*, the tubular member 120 in combination with an attachment member 122 collectively form an attachment means 121 for attaching the valance onto the peripheral frame 20. As illustrated, the attachment member 122 carries a pair of elongate spaced apart fingers 124, 126 defining an elongate slot 128 adapted to receive the elongate tubular member 120 described above. Preferably, the attachment member 122 is formed of an extruded resilient rubber material such as buteryate to allow the tubular member 120 and upper end 100 of the valance to be selectively inserted therein as desired. A base portion 130 of the attachment member 122 is substantially planar and is thereby adapted for connection with the front face surface 74 of the lateral support member 30 using a suitable fastener 123 as shown in FIG. 4*a*.

It is to be appreciated that the attachment means 121 extends not only across the entire longitudinal length of the lateral support member 30 but also along the entire longitudinal length of both the first transverse support member 26 and the second transverse support member 28. In that way, the first and second portions 80, 82 of the valance member 32 are carried on the first and second transfer support members 26, 28. Preferably the attachment arrangement of the first and second portions 80, 82 of the valance member 32 on the first and second transverse support members 26, 28 is as described above in connection with the lateral support member 30. In this way, the entire valance member 32 can be selectively installed onto the peripheral frame 20 as desired and removed therefrom when deemed necessary or appropriate or as desired.

The invention has been described with reference to the preferred embodiment. Obviously, modifications and alterations will occur to others upon reading and understanding this specification. As an example other forms or techniques for attaching the valance to one or more of the support members can be used such as hook and latch systems, decorative snaps, or the like. It is intended to include all such modifications and alterations insofar as they come within the scope of the appended claims or the equivalence thereof.

Having thus described the preferred embodiment, the invention is now claimed to be:

1. A method of retrofitting an associated metal awning system with a fabric valance member, the associated metal awning system including a peripheral frame carrying a substantially planar main body portion, the peripheral frame including an elongate lateral support member having first and second ends and forming a planar substantially rectangular front face surface having a front face surface height and a front face surface width, the method of retrofitting the associated metal awning system comprising:

providing a fabric valance member;

providing a tube and resilient groove attachment system including a first elongate tubular member carried in a fold formed by an upper edge of the fabric valance member, and a second elongate attachment member provided with a slot adapted to selectively receive the first elongate tubular member, the slot being defined by walls of the second elongate attachment member;

connecting said second elongate attachment member to said elongate lateral support member of said associated metal awning system using associated fasteners; and, receiving said first elongate tubular member carrying said fabric valance member in said slot defined by said walls of said second elongate attachment member.

2. A method of retrofitting an associated metal awning system with a fabric valance member, the associated metal awning system including a peripheral frame carrying a substantially planar main body portion, the peripheral frame including an elongate lateral support member having first and second ends and forming a planar substantially rectangular front face surface having a front face surface height and a front face surface width, the method of retrofitting the associated metal awning system comprising:

providing a fabric valance member; and, connecting said fabric valance member with said elongate lateral support member of said associated metal awning system to substantially cover all of said front face surface.

3. The method according to claim 2 wherein the step of providing said fabric valance member includes providing a fabric valance member having a height dimension greater than said front face surface height and having a width dimension greater than said front face surface width.

* * * * *

UNITED STATES PATENT AND TRADEMARK OFFICE

CERTIFICATE OF CORRECTION

PATENT NO. : 7,065,934 B2
APPLICATION NO. : 11/030029
DATED : June 27, 2006
INVENTOR(S) : John M. Allin It is certified that error appears in the above-identified patent and that said Letters Patent is hereby corrected as shown below:

Title page Item [60] Insert
This application is a DIV of 10/385,902, filed on March 11, 2003.

Signed and Sealed this

Twenty-second Day of July, 2008

JON W. DUDAS
*Director of the United States Patent and Trademark Office*